US009478166B2

(12) United States Patent
Pyo et al.

(10) Patent No.: US 9,478,166 B2
(45) Date of Patent: Oct. 25, 2016

(54) DRIVING METHOD FOR DIMMING AN ORGANIC LIGHT-EMITTING DIODE (OLED) DISPLAY

(71) Applicant: Samsung Display Co., Ltd., Yongin-si, Gyeonggi-do (KR)

(72) Inventors: Si-Baek Pyo, Yongin-si (KR); Young-Seob Kim, Yongin-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 18 days.

(21) Appl. No.: 14/225,216

(22) Filed: Mar. 25, 2014

(65) Prior Publication Data

US 2015/0097764 A1 Apr. 9, 2015

(30) Foreign Application Priority Data

Oct. 4, 2013 (KR) ..... 10-2013-0118675

(51) Int. Cl.
*G09G 3/30* (2006.01)
*G09G 3/32* (2016.01)

(52) U.S. Cl.
CPC .... *G09G 3/3233* (2013.01); *G09G 2300/0861* (2013.01); *G09G 2320/064* (2013.01)

(58) Field of Classification Search
CPC ..... G09G 3/3225; G09G 3/2007; G09G 3/3233; G09G 2320/064; G09G 2300/0861
USPC ..... 345/77
See application file for complete search history.

(56) References Cited

U.S. PATENT DOCUMENTS

| | | | | |
|---|---|---|---|---|
| 2010/0156865 | A1* | 6/2010 | Kreek et al. | 345/207 |
| 2011/0141090 | A1* | 6/2011 | Hong et al. | 345/211 |
| 2012/0062613 | A1 | 3/2012 | Park et al. | |
| 2013/0194316 | A1 | 8/2013 | Park et al. | |

FOREIGN PATENT DOCUMENTS

| | | | |
|---|---|---|---|
| KR | 10-2012-0028426 | A | 3/2012 |
| KR | 10-2013-0086877 | A | 8/2013 |

* cited by examiner

*Primary Examiner* — Gustavo Polo
(74) *Attorney, Agent, or Firm* — Knobbe, Martens, Olson & Bear, LLP

(57) ABSTRACT

A driving method for dimming an organic light-emitting diode (OLED) display is disclosed. In one aspect, the method includes selecting a dimming mode indicating a maximum luminance to be displayed by the OLED display based on an input and determining a luminance range from a plurality of luminance ranges. The determined luminance range comprises the maximum luminance of the dimming mode. The method also includes performing at least one of converting image data based at least in part on the dimming mode or controlling a duty ratio of an emission control signal, wherein the performing is based at least in part on the determined luminance range.

20 Claims, 5 Drawing Sheets

DRIVING METHOD FOR DIMMING AN ORGANIC LIGHT-EMITTING DIODE (OLED) DISPLAY

CROSS-REFERENCE TO RELATED APPLICATIONS

This application claims priority to and the benefit of Korean Patent Application No. 10-2013-0118675, filed on Oct. 4, 2013, in the Korean Intellectual Property Office, the entire contents of which are incorporated herein by reference in their entirety.

BACKGROUND

1. Field

The described technology generally relates to a driving method for dimming an organic light-emitting diode (OLED) display.

2. Description of the Related Technology

Organic light-emitting diode (OLED) displays use an organic compound as a light emitting material. OLED displays have excellent luminance and color purity. In addition, OLED displays have favorable characteristics such as thin profiles, light weight, and low power consumption. Thus, OLED displays are expected to be employed in various applications such as portable display devices and the like.

SUMMARY OF CERTAIN INVENTIVE ASPECTS

One inventive aspect is a dimming driving method for an OLED display in which in implementing a dimming mode of the OLED display, the dimming mode is divided into a plurality of luminance ranges according to the intensity of luminance and different dimming driving methods are respectively applied to the luminance ranges, corresponding to dimming modes of the luminance ranges, thereby naturally implementing consecutive dimming modes.

Another aspect is a dimming driving method for an OLED display including deciding to which luminance range among first to fourth luminance ranges defined corresponding to intensities of luminance a selected dimming mode corresponds, applying different dimming driving methods to luminance ranges to which the selected dimming mode corresponds, and driving a pixel unit, in response to an image data converted corresponding to the selected dimming mode and a control signal of which duty ratio is controlled.

The first luminance range may be an ultra high luminance range in which the luminance of the maximum gray scale corresponds to 300 nit to 250 nit, the second luminance range may be a high luminance range in which the luminance of the maximum gray scale corresponds to 250 nit to 170 nit, the third luminance range may be an intermediate luminance range in which the luminance of the maximum luminance corresponds to 170 nit to 70 nit, and the fourth luminance range may be a low luminance range in which the luminance of the maximum gray scale corresponds to 70 nit to 20 nit.

When the selected dimming mode corresponds to the first luminance range, a dimming driving method through image data conversion may be applied. The dimming driving method through the image data conversion may be a method of setting gray scales for each luminance in the area in which the luminance of the maximum gray scale is about 300 nit to a reference gray scale for each luminance, selecting a reference gray scale corresponding to the luminance of gray scales expressed by an image data in the selected dimming mode, and converting the image data according to the reference gray scale.

When the selected dimming mode corresponds to the second luminance range, about 250 nit which is the luminance of the maximum gray scale may be set to a reference luminance, a gamma value may be fixed based on the reference luminance, and a dimming driving method through the duty ratio control of an emission control signal may be applied.

In the dimming mode in which the luminance of the maximum gray scale is about 170 nit among dimming modes corresponding to the second luminance range, the on duty ratio of the emission control signal may be set to about 60%.

When the selected dimming mode corresponds to the third luminance range, the on duty ratio of the emission control signal may be fixed to about 60% and a dimming driving method through image data conversion may be applied.

In the dimming mode in which the luminance of the maximum gray scale is about 170 nit among dimming modes corresponding to the third luminance range, the reference luminance may be set to about 250 nit. In the dimming mode in which the luminance of the maximum gray scale is about 70 nit among dimming modes corresponding to the third luminance range, the reference luminance may be set to about 110 nit.

When the selected dimming mode corresponds to the fourth luminance range, about 110 nit which is the luminance of the maximum gray scale may be set to a reference luminance, a gamma value may be fixed based on the reference luminance, and a dimming driving method through the duty ratio control of an emission control signal may be applied.

In the dimming mode in which the luminance of the maximum gray scale is 70 nit among dimming modes corresponding to the second luminance range, the on duty ratio of the emission control signal may be set to about 60%. In the dimming mode in which the luminance of the maximum gray scale is 60 nit among dimming modes corresponding to the second luminance range, the on duty ratio of the emission control signal may be set to about 50.5%. In the dimming mode in which the luminance of the maximum gray scale is 50 nit among dimming modes corresponding to the second luminance range, the on duty ratio of the emission control signal may be set to about 41.8%. In the dimming mode in which the luminance of the maximum gray scale is 40 nit among dimming modes corresponding to the second luminance range, the on duty ratio of the emission control signal may be set to about 33.2%. In the dimming mode in which the luminance of the maximum gray scale is 30 nit among dimming modes corresponding to the second luminance range, the on duty ratio of the emission control signal may be set to about 24.5%. In the dimming mode in which the luminance of the maximum gray scale is 20 nit among dimming modes corresponding to the second luminance range, the on duty ratio of the emission control signal may be set to about 15.9%.

DETAILED DESCRIPTION OF CERTAIN INVENTIVE EMBODIMENTS

Figure 1:
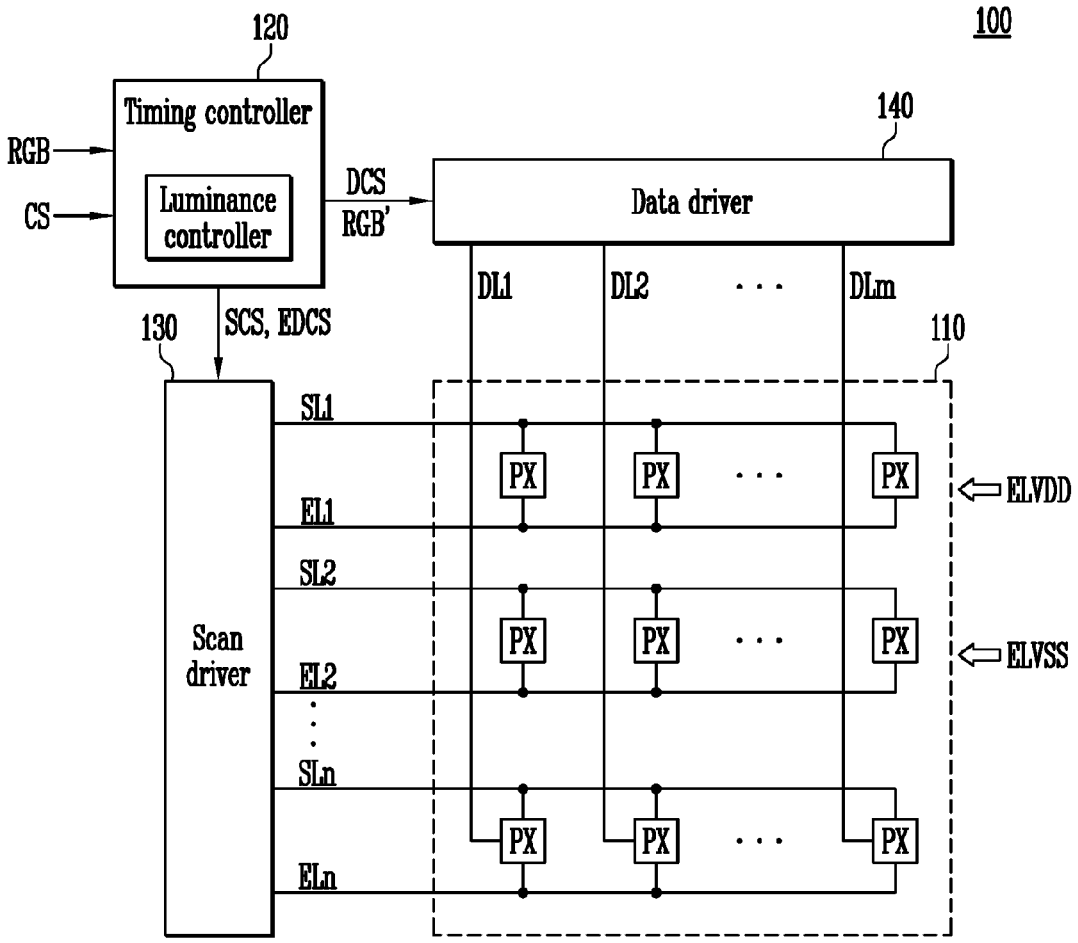
FIG. 1 is a block diagram illustrating an OLED display according to an embodiment.

The standard OLED display has a disadvantage in that it is difficult to implement a dimming mode for adjusting the luminance (brightness) of a displayed image.

Exemplary embodiments will now be described more fully hereinafter with reference to the accompanying drawings, however, they may be embodied in different forms and should not be construed as limited to the embodiments set forth herein. Rather, these embodiments are provided so that this disclosure will be thorough and complete, and will fully convey the scope of the embodiments to those skilled in the art.

In the drawings, the dimensions of the illustrated elements may be exaggerated for clarity of illustration. It will be understood that when an element is referred to as being "between" two elements, it can be the only element between the two elements, or one or more intervening elements may also be present Like reference numerals refer to like elements throughout.

Hereinafter, certain exemplary embodiments will be described with reference to the accompanying drawings. Here, when a first element is described as being coupled or connected to a second element, the first element may be not only directly coupled or connected to the second element but may also be indirectly coupled or connected to the second element via a third element. Further, some of the elements that are not essential to the complete understanding of the described technology are omitted for clarity. Also, like reference numerals refer to like elements throughout.

FIG. 1 is a configuration block diagram of an organic light-emitting diode (OLED) display according to an embodiment.

Referring to FIG. 1, the OLED display includes a pixel unit or display panel 110, a timing controller 120, a scan driver 130, and a data driver 140. The timing controller 120, the scan driver 130, and the data driver 140 may be respectively formed on separate semiconductor chips, or may be integrated in one semiconductor chip. The scan driver 130 may be formed on the same substrate as the pixel unit 110.

The pixel unit 110 includes a plurality of pixels PX arranged in a matrix at the intersections between scan lines SL1 to SLn arranged in rows and data lines DL1 to DLm arranged in columns. The pixels PX respectively receive scan and data signals supplied from the scan lines SL1 to SLn and the data lines DL1 to DLm. The pixels PX also receive an emission control signal supplied from an emission control signal line ELm. The pixels PX emit light, based on the scan signal, the data signal, the emission control signal and pixel power sources ELVDD and ELVSS, thereby display an image. The emission time of the pixels PX may be controlled in response to the emission control signal.

The scan driver 130 receives a scan control signal SCS and an emission duty control signal EDCS from the timing controller 120 to generate scan signals and emission control signals. In this embodiment, the duty ratio of the emission control signal is controlled in response to the emission duty control signal EDCS. The scan driver 130 may supply the generated scan signal and the generated emission control signal to the pixels PX through the scan lines SL1 to SLn and emission control signal lines EL1 to ELn. Pixels PX for each row are sequentially selected based on the scan signal so that data signals can be provided to the selected pixels. The emission time of the pixels PX may be controlled based on the emission control signal. Although it has been described in this embodiment that the scan signal and the emission control signal are generated by the same scan driver 130, the described technology is not limited thereto. The display device 100 may further include an emission control driver and the emission control signal may be generated by the emission control driver.

The data driver 140 receives a data control signal DCS and image data RGB' from the timing controller 120 and supplies data signals corresponding to the image data RGB' to the pixels PX through the data lines DL1 to DLm in response to the data control signal DCS. The data driver 140 converts the received image data RGB' into the data signals in the form of voltage or current.

The timing controller 120 generates signals SCS, EDCS, and DCS for controlling the scan driver 130 and the data driver 140 based on an image signal RGB and a control signal CS received from an external source. The timing controller 120 provides the generated signals to the scan driver 130 and the data driver 140. The control signal CS may be, for example, timing signals such as a vertical synchronization signal Vsync, a horizontal synchronization signal Hsync, a clock signal CLK, or a data enable signal DE, or a signal for setting a dimming mode. The timing controller 120 converts the image signal RGB received from the external source and provides the converted image signal to the data driver 140. The timing controller 120 includes a graphic RAM (GRAM) and may arbitrarily store, in the GRAM, an image signal RGB for one frame received from the external source.

The timing controller 120 may include a luminance controller 10. The luminance controller 10 may control the emission luminance of the pixel unit 110 by converting the image data RGB or controlling the duty ratio of the emission control signal based on a set predetermined dimming mode.

Hereinafter, a method of controlling luminance through image data conversion to correspond to the set dimming mode (FIG. 2) and a method of controlling luminance by controlling the duty ratio of an emission control signal (FIG. 3) will be described in detail with reference to FIGS. 2 and 3.

Figure 2:
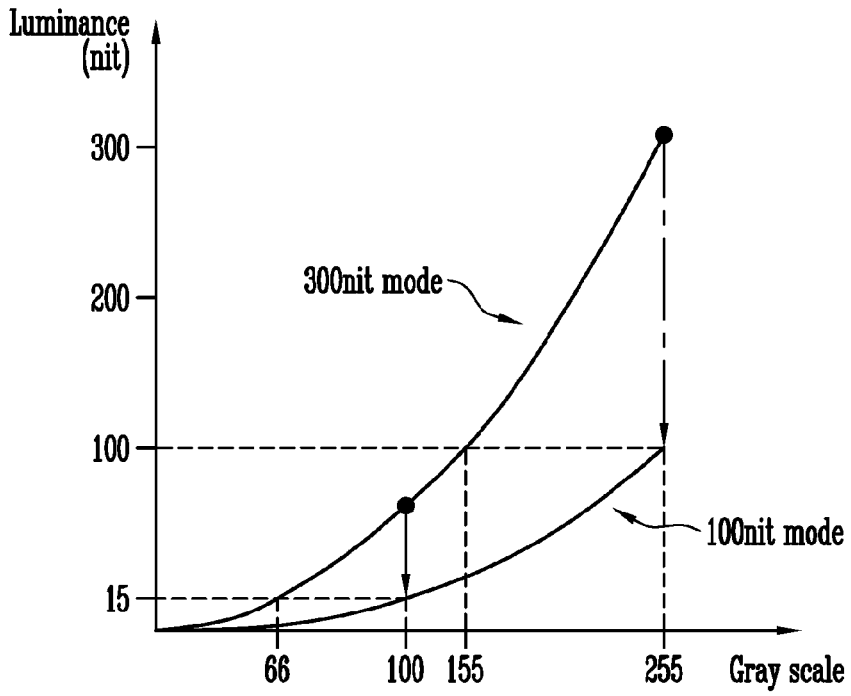
FIG. 2 is a diagram illustrating a dimming driving method including image data conversion.

FIG. 2 is a diagram illustrating a dimming driving method including image data conversion.

The FIG. 2 method controls luminance through image data conversion to correspond to a set dimming mode. In the method of FIG. 2, gray scales are set for each luminance at a predetermined luminance level, e.g., the maximum luminance level is set to a reference gray scale with respect to each luminance. When the set dimming mode is changed, a reference gray scale corresponding to the luminance of gray scales expressed by the image data is selected in the changed dimming mode and the image data is converted according to the reference gray scale.

FIG. 2 illustrates, as an embodiment, that when the dimming mode is changed into a dimming mode in which the luminance of the maximum gray scale becomes 100 nit, based on the maximum luminance level at which the luminance of the maximum gray scale (gray scale 255) is 300 nit (hereinafter, referred to as a 300 nit mode), the luminance is controlled to correspond to the changed dimming mode. Here, a nit is a luminance unit equal to 1 candle per square meter measured perpendicular to the rays from a source.

That is, the gray scales for each luminance in the 300 nit mode are set to a reference gray scale. When the image data in a 100 nit mode expressed in gray scale with 255 levels, the gray scale luminance necessarily becomes 100 nit. The reference gray scale corresponding to the luminance of 100 nit is gray scale 155. Thus, the image data expressing the gray scale 255 is converted into image data expressing the gray scale 155. As an example, when the image data is a 8-bit digital signal, the signal '11111111' expressing the gray scale 255 is converted into '10011011' expressing the gray scale 155. As another example, when the image data in the 100 nit mode expresses gray scale 100, the gray scale luminance in the gray scale 100 becomes 15 nit. Since the reference gray scale corresponding to 15 nit is gray scale 66, the image data expressing the gray scale 100 is changed into image data expressing the gray scale 66.

Accordingly, the dimming mode can be converted into a predetermined dimming mode (100 nit mode) by converting only the image data, without changing the settings (e.g., the voltage for each gray scale, etc.) of the display device 100 set in the 300 nit mode as the maximum luminance level.

Figure 3:
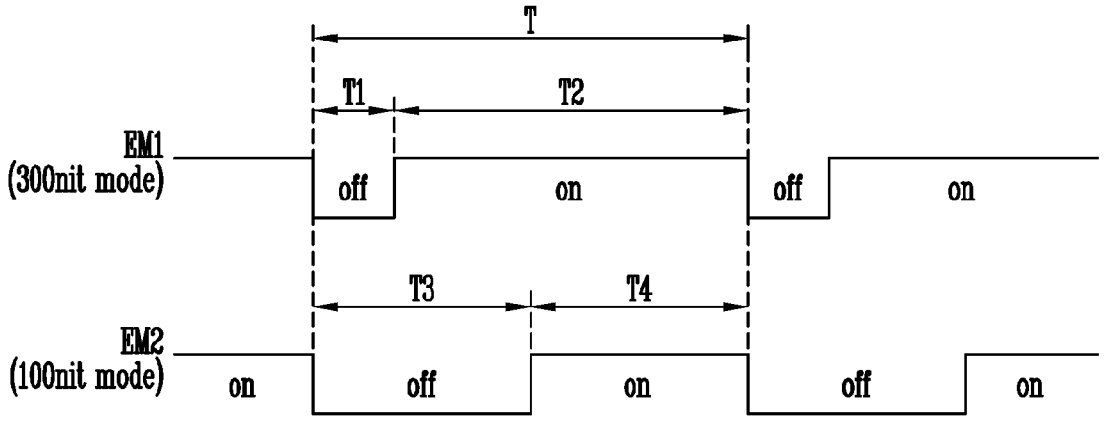
FIG. 3 is a diagram illustrating a dimming driving method including the duty ratio control of an emission control signal.

FIG. 3 is a diagram illustrating a dimming driving method including the duty ratio control of an emission control signal.

The FIG. 3 method includes controlling luminance by controlling the duty ratio of an emission control signal to correspond to a set dimming mode. In the method of FIG. 3, the luminance is changed by varying the on-period or off-period with respect to one period (e.g., one frame) of the emission control signal for controlling the emission and non-emission of the pixel PX. That is, the luminance is controlled by controlling the on duty ratio of an emission control signal. In this case, the duty ratios of emission control signals of 100%, 80%, 60%, 40%, 20% and 5% may be set. However, this is merely an example, and various duty ratios may be set according to user preferences.

Referring to FIG. 3, the on-period T2 of an emission control signal EM2 in the 100 nit mode is narrower than that T4 of an emission control signal EM1 in the 300 nit mode. Conversely, the off-period T3 of the emission control signal EM2 is longer than that T1 of the emission control signal EM1 in the 300 nit mode. When the pixel emits light in the on-period of the emission control signal and does not emit light in the off-period of the emission control signal, the luminance may be lowered as the on-period of the emission control signal decreases or as the off-period of the emission control signal increases. The on duty ratios of the emission control signals EM1 and EM2 for each luminance mode may be set by considering the unique characteristics of the pixel unit 110.

Referring back to FIG. 1, the luminance controller 10 changes the dimming mode into a predetermined dimming mode by applying the method of converting the image data or the method of controlling the duty ratio of an emission control signal, or by a combination of the methods.

In implementing the dimming mode of the OLED display, the dimming mode is divided into a plurality of luminance ranges according to the intensity of luminance and different dimming driving methods are respectively applied to the luminance ranges corresponding to dimming modes of the luminance ranges. Accordingly, consecutive dimming modes can be naturally implemented.

More specifically, when the dimming mode is set as a dimming mode corresponding to an ultra high luminance range, e.g., a dimming mode in which the luminance of the maximum luminance (gray scale 255) is in the range of about 300 nit to about 250 nit (hereinafter, referred to as a 300 nit to 250 nit mode), the dimming driving method including the image data conversion is applied, as illustrated in FIG. 2.

When the dimming mode is set as a dimming mode corresponding to a high luminance range, e.g., a dimming mode corresponding to a 250 nit to 170 nit mode, the luminance of the maximum gray scale, i.e., the reference luminance is set to about 250 nit, and the gamma value is fixed based on the reference luminance. Then, the luminance is controlled by controlling the on duty ratio of the emission control signal as shown in FIG. 3. For example, in the 170 nit mode, the on duty ratio of the emission control signal may be set to about 60%.

That is, in dimming modes corresponding to the high luminance range, the luminance is decreased by equally setting the reference luminance and decreasing the on duty ratio of the emission control signal. In these embodiments, the image data is converted by being set using a 250 nit reference luminance in the 250 nit dimming mode. The on duty ratio is decreased so that the luminance of an image displayed in the pixel unit 110 can be decreased according to the dimming mode.

When the dimming mode is set as a dimming mode corresponding to an intermediate luminance range, e.g., a 170 nit to 70 nit mode, the on duty ratio of the emission control signal is set as about 60% and the dimming driving method including the image data conversion as illustrated in FIG. 2 is applied.

Since the on duty ratio of the emission control signal is about 60%, the luminance is lower than that when the on duty ratio of the emission control signal is about 100%. Thus, in the application of the dimming driving method described in FIG. 2, the about 170 nit mode sets the luminance of the maximum gray scale, i.e., the reference luminance to about 250 nit instead of about 170 nit and the about 70 nit mode sets the reference luminance to about 110 nit instead of about 70 nit.

For example, the about 170 nit mode sets the reference luminance to about 250 nit and sets the on duty ratio of the emission control signal to about 60%, so that the luminance of the image displayed in the pixel unit 110 can be about 170 nit.

When the dimming mode is set as a dimming mode corresponding to a low luminance range, e.g., a about 70 nit to about 20 nit, the luminance of the maximum gray scale, i.e., the reference luminance is set to about 110 nit, and the gamma value is fixed based on the reference luminance. Then, the luminance is controlled by controlling the on duty ratio of the emission control signal as shown in FIG. 3. In the 70 nit mode, the on duty ratio of the emission control signal may be set to about 60%. In the 60 nit mode, the on duty ratio of the emission control signal may be set to about 50.5%. In the 50 nit mode, the on duty ratio of the emission control signal may be set to about 41.8%. In the 40 nit mode, the on duty ratio of the emission control signal may be set to about 33.2%. In the 30 nit mode, the on duty ratio of the emission control signal may be set to about 24.5%. In the 20 nit mode, the on duty ratio of the emission control signal may be set to about 15.9%.

That is, the luminance controller 10 is operated by defining dimming modes (a 300 nit to 250 nit mode, a 250 nit to 170 nit mode, a 170 nit to 70 nit mode and a 70 nit to 20 nit mode) with respect to a plurality of luminance ranges (an ultra high luminance range, a high luminance range, an intermediate luminance range and a low luminance range) corresponding to the intensities of the desired luminance, and applying an optimized dimming driving method to a dimming mode corresponding to each luminance range.

Figure 4:
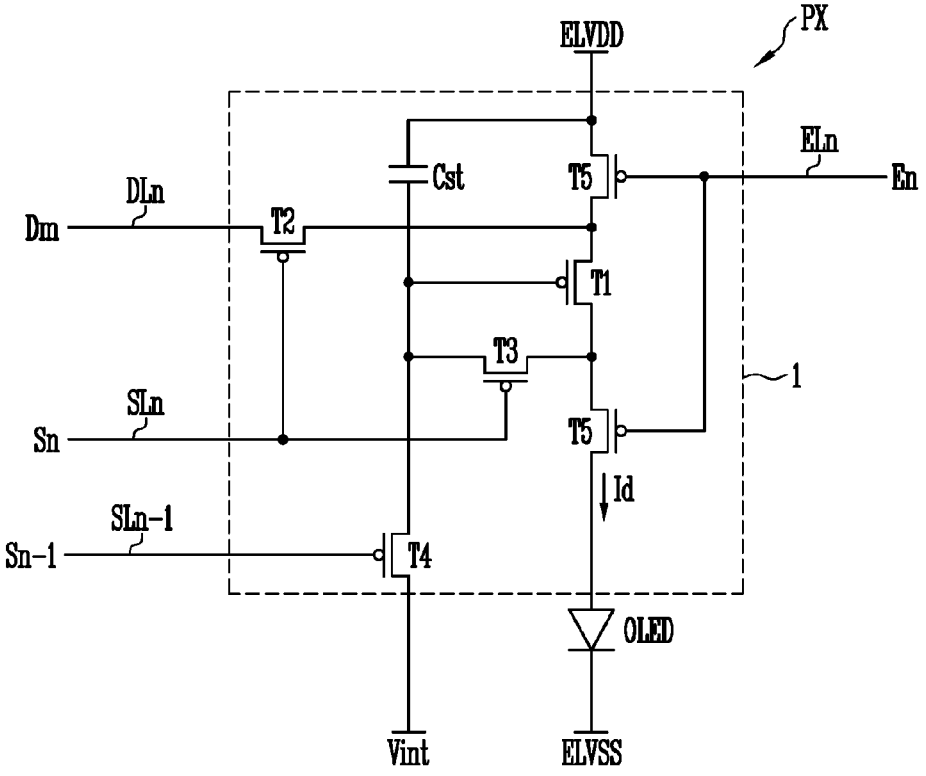
FIG. 4 is a circuit diagram for the pixel shown in FIG. 1.
Figure 5:
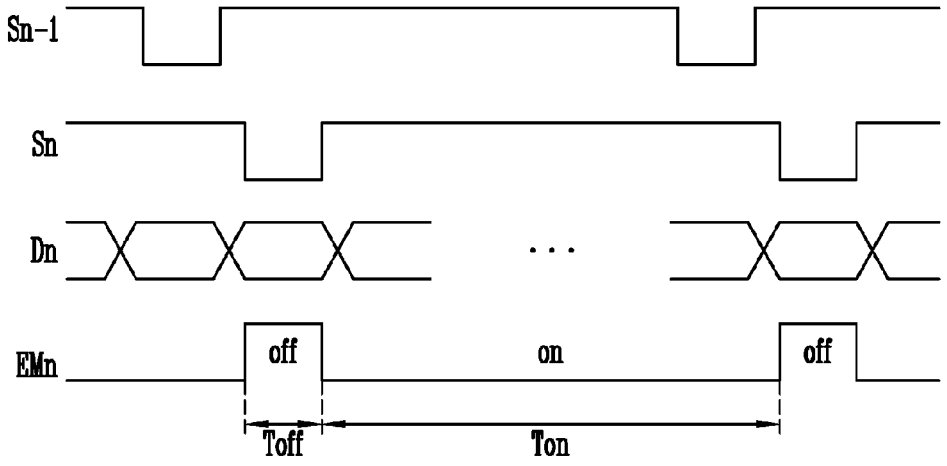
FIG. 5 is a driving waveform diagram of the pixel shown in FIG. 4.

FIG. 4 is a circuit diagram illustrating the pixel shown in FIG. 1. FIG. 5 is a driving waveform diagram of the pixel shown in FIG. 4.

Referring to FIGS. 4 and 5, the pixel PX includes a pixel circuit 1 including transistors T1 to T6 and a capacitor Cst, and an organic light-emitting diode (OLED).

The transistors T1 to T6 may be thin film transistors (TFTs). Although it has been described in this embodiment that the transistors T1 to T6 are configured as P-type transistors, the transistors T1 to T6 may be configured as N-type transistors, and may be driven by reversing the driving waveform of FIG. 5. Although it has been described in this embodiment that the pixel circuit 1 includes six transistors T1 to T6 and one capacitor Cst, the described technology is not limited thereto. The number of transistors and capacitors constituting the pixel circuit 1 may be varied.

The OLED receives a driving voltage through the pixel circuit 1 to emit light.

During an initialization period, a previous scan signal Sn-1 of a low level is applies through a previous scan line SLn-1. An initialization transistor T4 is turned on corresponding to the previous scan signal Sn-1 having the low level and an initialization voltage Vint is applied to a gate electrode of a driving transistor T1 through the initialization transistor T4. Accordingly, the driving transistor T1 is initialized by the initialization voltage Vint.

Subsequently, during a programming period, a scan signal Sn of a low level is applied through a scan line SLn. Then, a switching transistor T2 and a compensation transistor T3 are turned on corresponding to the scan signal Sn having the low level.

In the FIG. 4 embodiment, the driving transistor T1 is diode-connected by the turned-on compensation transistor T3, and is thereby forward-biased.

Then, the compensation voltage Dm+Vth (Vth is a negative (−) value) decreased by the threshold voltage Vth of the driving transistor T1 is applied from a data line DLm to the gate electrode of the driving transistor T1.

The driving voltage ELVDD and the compensation voltage Dm+Vth are applied to opposing terminals of the capacitor Cst and an electric charge corresponding to the difference in voltage between the terminals is stored in the capacitor Cst. Subsequently, during an emission section Ton, an emission control signal EMn supplied from an emission control signal line ELn is changed from a high level to a low level. During the emission section Ton, an operation control transistor T5 and an emission control transistor T6 are turned on by the emission control signal EMn having the low level.

Then, a driving current Id is generated based on the difference between the voltage of the gate electrode of the driving transistor T1 and the driving voltage ELVDD. The driving current Id is applied to the OLED through the emission control transistor T6.

During an emission period, the gate-source voltage Vgs of the driving transistor T1 is maintained as {(Dm+Vth)−ELVDD} by the storage capacitor Cst. According to the current-voltage relation of the driving transistor T1, the driving current Id is in proportion to the square of a value obtained by subtracting the threshold voltage from the gate-source voltage. That is, the emission luminance of the OLED may be controlled according to the data signal Dm.

In addition, the emission luminance of the OLED may be controlled according to the duty ratio of the emission section Ton of the OLED or the duty ratio of a non-emission section Toff of the OLED. Although the same data signal Dm is applied, the emission luminance of the OLED increases as the duty ratio of the emission period Ton for one period including the emission section Ton and the non-emission section Toff, e.g., a display section of one frame, increases. Conversely, the emission luminance of the OLED decreases as the duty ratio of the non-emission section Toff for the display section of the one frame increases. Thus, the emission luminance of the OLED can be controlled according to the data signal Dm and the emission control signal EMn.

Figure 6:
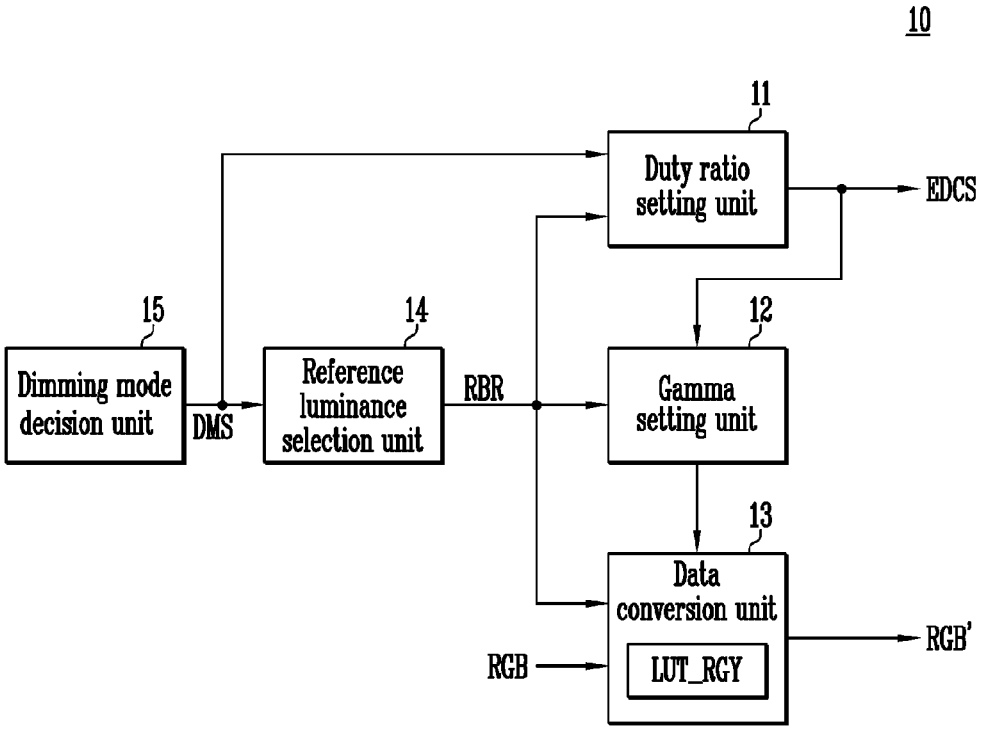
FIG. 6 is a block diagram illustrating an embodiment of the luminance controller of FIG. 1.

FIG. 6 is a block diagram illustrating an embodiment of the luminance controller of FIG. 1.

Referring to FIG. 6, the luminance controller 10 may include a dimming mode decision unit 15, a reference luminance selection unit 14, a duty ratio setting unit 11, a gamma setting unit 12, and a data conversion unit 13.

The luminance controller 10, as described above, is operated by defining dimming modes (a 300 nit to 250 nit mode, a 250 nit to 170 nit mode, a 170 nit to 70 nit mode, and a 70 nit to 20 nit mode) with respect to a plurality of luminance ranges (an ultra high luminance range, a high luminance range, an intermediate luminance range and a low luminance range) corresponding to the intensities of luminance and applying an optimized dimming driving method to a dimming mode corresponding to each luminance range.

That is, the luminance controller 10 decides to which luminance range luminance range the selected dimming mode corresponds and generates an emission duty control signal EDCS and/or converts an image data RGB, in response to the corresponding dimming mode based on a predetermined reference luminance for each luminance range. The luminance controller 10 provides the converted image data RGB' to the data driver 140.

The dimming mode decision unit 15 determines the corresponding luminance range among the plurality of luminance ranges (the ultra high luminance range, the high luminance range, the intermediate luminance range and the low luminance range) defined corresponding to the intensities of luminance of the dimming mode selected by a user and outputs the result as a dimming mode signal DMS.

The reference luminance selection unit 14 may select a reference luminance corresponding to the dimming mode signal DMS in response to the dimming mode signal DMS. For example, the dimming mode (300 nit to 250 nit mode) corresponding to the ultra high luminance range has a reference luminance of about 300 nit, the dimming mode (250 nit to 170 nit mode) corresponding to the high luminance range has a reference luminance of about 250 nit, and the dimming mode (70 nit to 20 nit mode) corresponding to the low luminance range has a reference luminance of about 110 nit.

However, in the dimming mode (170 nit to 70 nit mode) corresponding to the intermediate luminance range, the reference luminance may be changed based on the luminance of the dimming mode. For example, the 170 nit mode sets the reference luminance to about 250 nit, and the 70 nit mode sets the reference luminance to about 110 nit.

The duty ratio setting unit 11, the gamma setting unit 12, and the data conversion unit 13 may be operated in response to a reference luminance RBR output from the reference luminance selection unit 14.

The duty ratio setting unit 11 may generate and output an emission duty control signal EDCS for controlling the duty ratio of the emission control signal in response to the reference luminance RBR and the dimming mode signal DMS. The emission duty control signal EDCS may set the duty ratio of the non-emission section or emission section of the emission control signal to a value within the range of about 10% to about 90%.

However, in the dimming mode (300 nit to 250 nit mode) corresponding to the ultra high luminance range, the dimming driving method including the image data conversion is applied, and therefore, a separate emission duty control signal may not be output.

In the dimming mode (170 nit to 70 nit mode) corresponding to the intermediate area, an emission duty control signal may be output so that the on duty ratio of the emission control signal is fixed to about 60%.

The gamma setting unit 12 is used to set a gamma value corresponding to the selected dimming mode. The gamma setting unit 12 includes a lookup table in which gamma values are mapped according to the dimming mode and the gamma value may be selected with reference to the lookup table.

The data conversion unit 13 may generate and output an image data RGB' obtained by converting an image data RGB according to the dimming mode. The data conversion unit 13 may include a reference gray scale lookup table LUT_RGY in which the reference gray scale for each luminance is mapped based on a predetermined luminance and a predetermined gamma value. The predetermined luminance may be an initial luminance or maximum luminance level set before the luminance is changed. For example, the predetermined luminance may be about 300 nit, and the predetermined gamma value may be about 2.2.

The gamma setting unit 12 calculates luminance for each gray scale according to the reference luminance and the gamma value and selects a reference gray scale corresponding to the calculated luminance from the reference gray scale lookup table LUT_RGY. Subsequently, the image data RGB can be converted into the image data RGB' expressing the reference gray scale.

Figure 7:
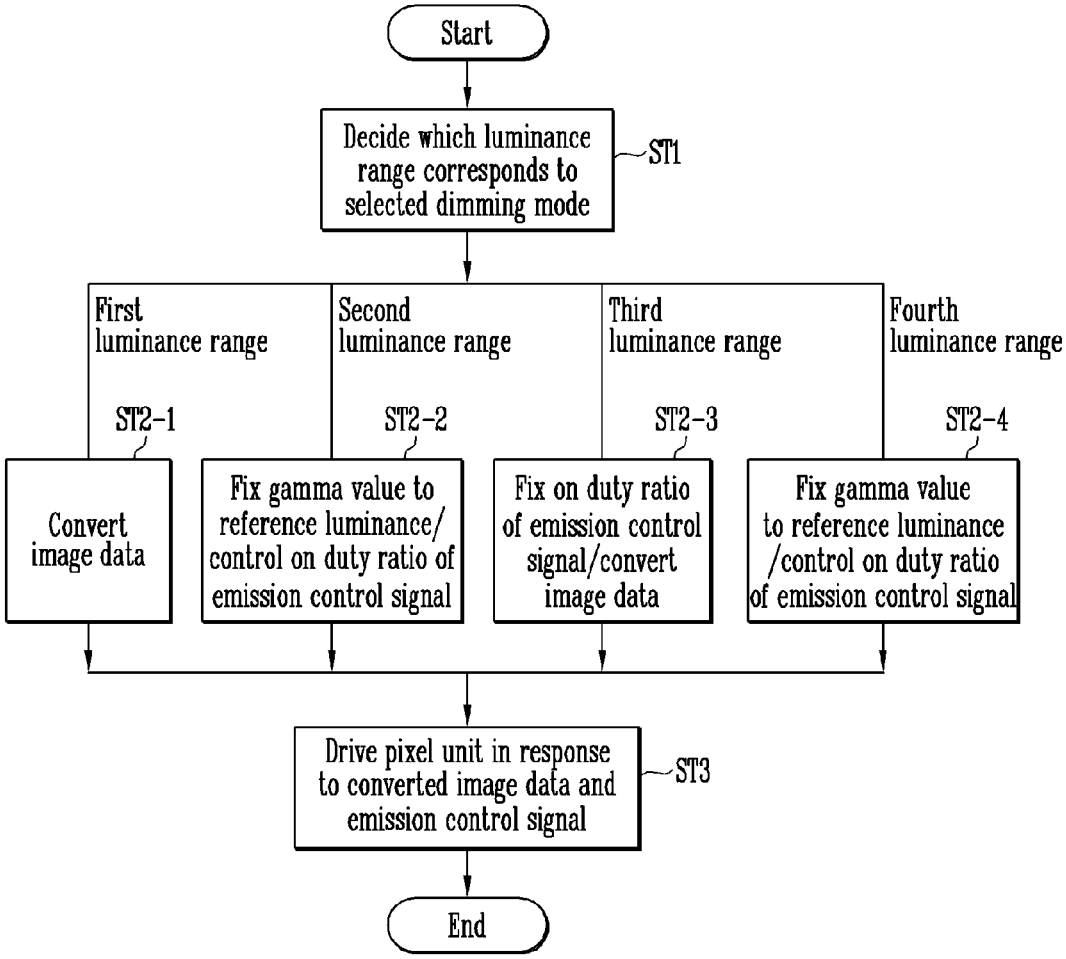
FIG. 7 is a flowchart illustrating a dimming driving method of the organic light emitting display device according to the embodiment.

FIG. 7 is a flowchart illustrating a dimming driving method of the OLED display according to an embodiment. In some embodiments, the method of FIG. 7 is implemented in a conventional programming language, such as C or C++ or another suitable programming language. The program can be stored on a computer accessible storage medium of the device 100, for example, the design file storage unit 130. In certain embodiments, the storage medium includes a random access memory (RAM), hard disks, floppy disks, digital video devices, compact discs, video discs, and/or other optical storage mediums, etc. The program may be stored in a processor. The processor can have a configuration based on, for example, i) an advanced RISC machine (ARM) microcontroller and ii) Intel Corporation's microprocessors (e.g., the Pentium family microprocessors). In certain embodiments, the processor is implemented with a variety of computer platforms using a single chip or multichip microprocessors, digital signal processors, embedded microprocessors, microcontrollers, etc. In another embodiment, the processor can execute applications with the assistance of operating systems such as Unix, Linux, Microsoft DOS, Microsoft Windows 7/Vista/2000/9x/ME/XP, Macintosh OS, OS/2, Android, iOS and the like. In another embodiment, at least part of the procedure can be implemented with embedded software. Depending on the embodiment, additional states may be added, others removed, or the order of the states changed in FIG. 7.

Referring to FIG. 7, it is decided to which luminance range among first to fourth luminance ranges (an ultra high luminance range, a high luminance range, an intermediate luminance range and a low luminance range) defined according to the intensities of luminance the dimming mode selected by a user corresponds and the result is output as a dimming mode signal DMS (ST1).

For example, the dimming mode corresponding to the ultra high luminance range (first luminance range) is a 300 nit to 250 nit mode, the dimming mode corresponding to the high luminance range (second luminance range) is a 250 nit to 170 nit mode, the dimming mode corresponding to the intermediate luminance range (third luminance range) is a 170 nit to 70 nit mode, and the dimming mode corresponding to the low luminance range (fourth luminance range) is a 70 nit to 20 nit mode.

When the selected dimming mode is a dimming mode corresponding to the ultra high luminance range, the dimming driving method including the image data conversion as illustrated in FIG. 2 is applied (ST2-1).

That is, gray scales for each luminance in a 300 nit mode in which the luminance of the maximum gray scale (gray scale 255) is 300 nit are set to a reference gray scale with respect to each luminance and a reference gray scale corresponding to the luminance of gray scales expressed by an image data is selected in the selected dimming mode. Then, the image data is converted according to the reference gray scale.

When the selected dimming mode is a dimming mode corresponding to the high luminance range, the luminance of the maximum gray scale, i.e., the reference luminance is set to about 250 nit and the gamma value is fixed based on the reference luminance. Then, the method of controlling luminance by controlling the on duty ratio of an emission control signal, i.e., the dimming driving method including the duty ratio control of the emission control signal as illustrated in FIG. 3 is applied (ST2-2).

The on duty ratio of the emission control signal may be set to about 60% in the about 170 nit mode.

That is, in dimming modes corresponding to the high luminance range, the luminance is decreased by equally setting the reference luminance and decreasing the on duty ratio of the emission control signal. In these embodiments, the image data is converted by being set when the dimming mode is about 250 nit as a reference luminance. However, the on duty ratio is decreased, so that the luminance of an image displayed in the pixel unit 110 can be decreased according to the dimming mode.

When the selected dimming mode is a dimming mode corresponding to the intermediate luminance range, the on duty ratio of the emission control signal is fixed to about 60% and the dimming driving method including the image data conversion as illustrated in FIG. 2 is applied (ST2-3).

However, since the on duty ratio of the emission control signal is about 60%, the luminance is lower than when the on duty ratio of the emission control signal is about 100%. Thus, in the application of the dimming driving method described in FIG. 2, the 170 nit mode sets the luminance of the maximum gray scale, i.e., the reference luminance to about 250 nit instead of about 170 nit and the 70 nit mode sets the reference luminance to about 110 nit instead of about 70 nit.

For example, the 170 nit mode sets the reference luminance to about 250 nit and sets the on duty ratio of the emission control signal to about 60% so that the luminance of the image displayed in the pixel unit 110 can be about 170 nit.

When the selected dimming mode is a dimming mode corresponding to the low luminance range, the luminance of the maximum gray scale, i.e., the reference luminance is set to about 110 nit and the gamma value is fixed based on the reference luminance. Then, the dimming driving method including the duty ratio control of the emission control signal as illustrated in FIG. 3 is applied (ST2-4).

In the 70 nit mode, the on duty ratio of the emission control signal may be set to about 60%. In the 60 nit mode, the on duty ratio of the emission control signal may be set to about 50.5%. In the 50 nit mode, the on duty ratio of the emission control signal may be set to about 41.8%. In the 40 nit mode, the on duty ratio of the emission control signal may be set to about 33.2%. In the 30 nit mode, the on duty ratio of the emission control signal may be set to about 24.5%. In the 20 nit mode, the on duty ratio of the emission control signal may be set to about 15.9%.

Subsequently, the pixel unit is driven in response to the image data converted through one of the steps ST2-1 to ST2-4, corresponding to the selected dimming mode, and the emission control signal with the controlled duty ratio (ST3).

By way of summation and review, the standard dimming driving method includes equally applying a gamma table in the maximum luminance level to each dimming step including a low luminance level, using a method of previously setting predetermined dimming steps (luminance levels) in order to implement a dimming mode of an OLED display and collectively applying a fixed gamma table to the gamma implementation of a dimming mode for each step.

However, the luminance and color of an image displayed for each dimming mode may be non-uniform and the luminance cannot be controlled except some predetermined dimming modes.

According to at least one embodiment, in implementing a dimming mode of the OLED display, the dimming mode is divided into a plurality of luminance ranges according to the intensity of luminance without dividing a luminance level corresponding to each dimming mode into fixed steps and different dimming driving methods are respectively applied to the luminance ranges corresponding to dimming modes of the luminance ranges, thereby naturally implementing consecutive dimming modes.

Exemplary embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims.

What is claimed is:

1. A driving method for dimming an organic light-emitting diode (OLED) display, comprising:

selecting a dimming mode indicating a maximum luminance to be displayed by the OLED display based on an input;

determining a luminance range from a plurality of predefined luminance ranges, wherein the determined luminance range includes the maximum luminance of the dimming mode; and performing at least one of i) converting image data based at least in part on the dimming mode or ii) controlling a duty ratio of an emission control signal, wherein the performing is based at least in part on the determined luminance range.

2. The driving method of claim 1, wherein the luminance ranges comprise first to fourth luminance ranges, wherein the first luminance range includes a maximum gray scale with a luminance in the range of about 300 nit to about 250 nit, wherein the second luminance range includes a maximum gray scale with a luminance in the range of about 250 nit to about 170 nit, wherein the third luminance range includes a maximum luminance in the range of about 170 nit to about 70 nit, and wherein the fourth luminance range includes a maximum gray scale in the range of about 70 nit to about 20 nit.

3. The driving method of claim 2, wherein the performing comprises converting the image data when the determined luminance range is the first luminance range.

4. The driving method of claim 3, wherein the converting comprises:

setting a gray scale for each luminance level to a reference gray scale;

selecting a reference gray scale corresponding to the luminance level of each gray scale of the image data; and converting the image data based at least in part on the selected reference gray scales.

5. The driving method of claim 2, wherein the performing comprises setting the luminance of the maximum gray scale as a reference luminance, fixing a gamma value based at least in part on the reference luminance and controlling of the duty ratio of the emission control signal when the determined luminance range is the second luminance range.

6. The driving method of claim 5, wherein the duty ratio is about 60% when the maximum gray scale is about 170 nit.

7. The driving method of claim 2, wherein the performing comprises controlling the duty ratio to be about 60% and performing the converting of the image data when the determined luminance range is the third luminance range, wherein the converting is based at least in part on a reference luminance.

8. The driving method of claim 7, wherein the performing comprises setting the reference luminance to about 250 nit when the maximum gray scale is about 170 nit.

9. The driving method of claim 7, wherein the performing comprises setting the reference luminance to about 110 nit when the maximum gray scale is about 170 nit.

10. The driving method of claim 2, wherein the performing comprises setting the luminance of the maximum gray scale as a reference luminance, fixing a gamma value based at least in part on the reference luminance, and controlling of the duty ratio of the emission control signal when the determined luminance range is the fourth luminance range.

11. The driving method of claim 10, wherein the duty ratio of the emission control signal is set to about 60% when the maximum gray scale is about 70 nit.

12. The driving method of claim 10, wherein the duty ratio of the emission control signal is set to about 50.5% when the maximum gray scale is about 60 nit.

13. The driving method of claim 10, wherein the duty ratio of the emission control signal is set to about 41.8% when the maximum gray scale is about 50 nit.

14. The driving method of claim 10, wherein the duty ratio of the emission control signal is set to about 33.2% when the maximum gray scale is about 40 nit.

15. The driving method of claim 10, wherein the duty ratio of the emission control signal is set to about 24.5% when the maximum gray scale is about 30 nit.

16. The driving method of claim 10, wherein the duty ratio of the emission control signal is set to about 15.9% when the maximum gray scale is about 20 nit.

17. A driving method for dimming an organic light-emitting diode (OLED) display, the method comprising:

selecting one of a plurality of predefined luminance ranges, wherein the selected luminance range includes a maximum luminance to be displayed by the OLED display; and performing at least one of:

converting image data based at least in part on the selected luminance range; and setting a duty ratio of an emission control signal based at least in part on the selected luminance range.

18. The method of claim 17, further comprising:

setting a reference luminance and a gamma value based at least in part on the selected luminance range; and generating a reference gray scale based at least in part on the reference luminance and gamma value, wherein the converting is based at least in part on the reference gray scale.

19. The method of claim 18, wherein the setting is based at least in part on the reference luminance.

20. An organic light-emitting diode (OLED) display, comprising:

a display unit configured to display an image;

a memory storing a plurality of predefined luminance ranges; and a controller configured to:

determine a luminance range from the plurality of predefined luminance ranges, wherein the determined luminance range comprises a maximum luminance to be displayed by the display unit;

perform at least one of:

converting image data to converted image data based at least in part on the determined luminance range; and setting a duty ratio of an emission control signal based at least in part on the determined luminance range.

* * * * *